US009127417B2

(12) United States Patent
Risi

(10) Patent No.: US 9,127,417 B2
(45) Date of Patent: Sep. 8, 2015

(54) DEVICE FOR PROCESSING AND IN PARTICULAR FOR DEMOLISHING AND/OR MILLING HORIZONTAL, VERTICAL, OR INCLINED SURFACES WITH STEP LESS CUTS

(75) Inventor: Mirco Risi, San Giovanni in Persiceto (IT)

(73) Assignee: SIMEX S.R.L., San Giovanni in Persiceto (IL)

( * ) Notice: Subject to any disclaimer, the term of this patent is extended or adjusted under 35 U.S.C. 154(b) by 0 days.

(21) Appl. No.: 14/001,760

(22) PCT Filed: Mar. 1, 2012

(86) PCT No.: PCT/EP2012/000901
§ 371 (c)(1),
(2), (4) Date: Nov. 1, 2013

(87) PCT Pub. No.: WO2012/116821
PCT Pub. Date: Sep. 7, 2012

(65) Prior Publication Data

US 2014/0042794 A1 Feb. 13, 2014

(30) Foreign Application Priority Data

Mar. 1, 2011 (IT) ..... B02011A0097

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/127
USPC ..... 299/39.6, 39.5, 36.1
See application file for complete search history.

(56) References Cited

U.S. PATENT DOCUMENTS

| | | | | |
|---|---|---|---|---|
| 4,803,789 | A * | 2/1989 | Hackmack | 299/39.6 |
| 5,381,616 | A * | 1/1995 | Disney | 37/94 |
| 6,116,699 | A * | 9/2000 | Kaczmarski et al. | 299/39.5 |
| 2009/0232598 | A1 | 9/2009 | Cochran et al. | 404/86 |

FOREIGN PATENT DOCUMENTS

| | | |
|---|---|---|
| DE | G 94 07 487.9 | 7/1994 |
| DE | 20 2010 010 857 | 10/2010 |

* cited by examiner

*Primary Examiner* — John Kreck
(74) *Attorney, Agent, or Firm* — Fattibene and Fattibene LLC; Paul A. Fattibene

(57) ABSTRACT

A device (100) is provided for the demolishing and in particular for milling horizontal, vertical and inclined surfaces or layers suitable for pedestrians and/or vehicles such as for instance asphalt and/or concrete roads. The device comprises rotatable working means (10) rotatably fixed to a main supporting frame (T) which comprises a first supporting element (L) and a second supporting element (F). The device also comprises regulating means adapted to adjust the position of the first supporting element (L) with respect to the main frame (T) independently of the position of the second supporting element (F). The regulating means comprise an arm (R) fixed to the main frame (T) so as to be free to rotate or translate. The first supporting element (L) is rotatably fixed to a portion (H) of the arm (L).

20 Claims, 13 Drawing Sheets

DEVICE FOR PROCESSING AND IN PARTICULAR FOR DEMOLISHING AND/OR MILLING HORIZONTAL, VERTICAL, OR INCLINED SURFACES WITH STEP LESS CUTS

TECHNICAL FIELD OF THE INVENTION

The present invention relates to the field of the processing of horizontal, vertical or inclined solid surfaces. In particular, the present invention relates to the field of processing of solid surfaces such as roads, footpaths, or similar surfaces. More in detail, the present invention relates to a device for demolishing and/or milling horizontal, vertical or inclined solid surfaces such as for example roads, footpaths, or surfaces made in general of a solid material such as for example asphalt or concrete. Even more in detail, the present invention is related to a device of the type previously described adapted to be actuated by a main operating machine, said device being in this case applied to the front part of said operating machine, or being linked to said operating machine by means of a linking arm, for example a hydraulically actuated articulated arm.

DESCRIPTION OF THE STATE OF THE ART

In the state of the art devices are known for processing and, in particular, for demolishing and/or milling roads footpaths and/or horizontal, vertical or inclined solid surfaces in general.

An example of a device known from the prior art is shown in FIGS. 1, 2, 3*a* and 3*b*. As apparent for example from FIGS. 1 and 2, the devices of known type (identified in FIGS. 1 and 2 by the reference letter B) comprise a main frame T to which a working and/or demolishing or milling drum 10 is rotatably fixed. The working drum 10 is provided with working tools 11 which protrude from the outer surface of said drum 10. The position of the drum 10 with respect to the mainframe T may be varied depending on the needs and/or circumstances, so as to define the working depth p and, thus, the thickness of the surface S to be milled and/or ground. This means in particular that the distance between the rotation axis A and the mainframe T can be chosen and defined depending on the needs and/or circumstances. For instance, in case of particularly tough surfaces Sr, the working depth p of a single milling operation or pass (i.e. the distance between the original surface S and the surface S" defined by the drum 10) may be reduced and the overall and final depth of processing, obtained by means of the drum 10, may be achieved by means of repeated and subsequent passes. In order to enable adjustment of the working depth p and, thus, of the position of the drum 10 with respect to the main frame T, the devices of known type comprise two slides F and L fixed to the main frame T and defining respective supporting or contacting portions adapted to be brought into contact with the upper surface S of the layer Sr to be processed or milled. Said supporting slides F and L may be moved with respect to the main frame T (and thus with respect to drum 10). Therefore, by determining or choosing the position of the slides F and L with respect to the mainframe T, the working depth p of a single pass is chosen and defined.

The devices of known type have nevertheless the considerable disadvantage consisting in the fact that the position of the supporting slides F and L with respect to the mainframe T cannot be adjusted independently for each slide F and/or L. Conversely, the regulating means of the devices known in the state of the art only enable simultaneous adjustment and/or movement of the slides F and L. The features of the devices of known type causes therefore drawbacks schematically represented in FIGS. 2, 3*a* and 3*b*. From FIG. 2, one can infer that, in case a second pass or milling operation is to be carried out (in order to form a second furrow in the layer at a position immediately adjacent to the furrow Sc formed with the first pass) and in case one does not intend or wish to leave between a pass and the following one (between the first furrow Sc and a second furrow) any solid material not removed from the layer Sr, then the device B is to be positioned in such a way that one of the slides F and L (the supporting slide L in the case of FIG. 2) is positioned in correspondence to the furrow Sc formed during the previous pass and, thus, in such a way that the same supporting slide L is not allowed to come into contact with a corresponding portion of the surface S of the layer Sr which is still to be processed or milled. Conversely, the supporting slide L will be positioned in correspondence to the furrow Sc and, in particular, to a portion of the surface S of the furrow Sc in which the material has already been removed, milled or ground. Therefore, the device B will have to operate in unstable conditions, thus risking that the device slants towards the previous pass or excavation or furrow Sc. However, in this case the working depth of the second pass (of the second furrow) might be different from the working depth of the first furrow Sc, or the surface of the second furrow might have an inclination which is variable or not corresponding to that of the first pass. A further operation in correspondence to the second pass (in the second furrow) will thus be required in order to make the final surfaces of the first and of the second furrow uniform. In order to overcome and obviate the drawbacks described above, when carrying out the second pass or furrow adjacent to the first pass or first furrow, the operator may position the device B as shown in FIG. 3*a*, thus leaving between the first and second pass (between the first furrow Sc and the second furrow) a portion S' not removed, milled or processed of the layer Sr. In this case it will be possible to obviate the previously described drawbacks since all slides F and L will be in contact with the surface S of the layer Sr to be milled and the required stability for the device B will thus be obtained. However, in this case, in order to make the first and second passes uniform, in particular in order to connect the two furrows formed during the first and second pass, it will be necessary to remove, as shown in FIG. 3*b*, the surface portion S' by means of a third pass or processing stage or milling. It can be inferred that, in this case, processing times are lengthened since in the case of the third pass the device B is partially exploited, in particular due to the fact that the working capacity of the drum 10 is only partially exploited since said drum is to process or mill a portion S' of the layer Sr having a remarkably lower width than its dimension (width along a direction parallel to the main rotation axis A).

Attempts have been made in the state of the art to address these problems. For instance, U.S. Pat. No. 8,002,360 and German utility model 94 07 487 disclose milling devices with side plates which may be adjusted independently. However, these and other devices known from the prior art still suffer from drawbacks related to their design and their performance reliability. For example, the devices known from the state of the art are based on a complicated design which generally relies on hydraulic, electric or air-based means for moving the mechanical parts making up the overall assembly. Furthermore, the devices known from the state of the earth prove generally unstable when operating on uneven and rough surfaces, since they are likely to lean or slant forward, backward or sideways in the presence of convex and concave surface irregularities such as bumps, holes, trenches, etc.

It is therefore an objective of the present invention to obviate the drawbacks previously mentioned and found in the solutions known from the state of the art. In particular, the goals and objectives of the present invention can be summarized as follows.

Proposing a solution which enables the formation of two adjacent passes or furrows without leaving during the second pass any residual layer portions S' still to be processed or milled between said first and second pass (between the first and the second furrow). In particular, a further goal of the present invention is to provide a device which enables independent position regulation of the two supporting slides with respect to the main support frame. Yet more in detail, a further goal of the present invention is to implement a device in which one of the two slides can be brought into contact with a corresponding portion of the surface S which is has yet to be processed or milled, while the second slide may be put or brought into contact with a surface portion S" of the adjacent furrow formed previously. Thus, the device according to the present invention will have to allow the two supporting slides to be brought into contact with corresponding surface portions having different heights or levels with respect to a reference height or level.

The mentioned and previously described goals and objectives will be achieved by means of a device for demolishing and in particular for milling horizontal, vertical and inclined surfaces suitable for pedestrians and/or vehicles such as for instance horizontal, vertical or inclined surfaces or layers made of asphalt or concrete or like solid materials as claimed. Further advantages will be obtained by means of the further embodiments of the present invention defined in the dependent claims.

DESCRIPTION OF THE PRESENT INVENTION

The present invention finds particular and convenient applications in the field of processing of horizontal, vertical or inclined solid surfaces or layers. In particular, the present invention finds particular and advantageous applications in the field of horizontal, vertical or inclined solid surfaces or layers such as roads, footpaths or similar surfaces. More specifically, the present invention can be advantageously applied to a device for demolishing and/or milling horizontal, vertical or inclined solid surfaces or layers such as for example roads, footpaths or surfaces in general which are made of solid materials such as for example asphalt or concrete. Thus, it is for this reason that the following examples will describe applications of the present invention of the actualization of equipment or machinery for the processing, in particular the demolition and/or milling of surfaces or layers of the type previously described.

It should be noted that possible applications of the present invention are not limited to the case of apparatuses for demolishing and/or milling solid surfaces or layers. Conversely, the present invention can be advantageously applied to all those cases in which it is necessary to process a layer by means of a device which is able to carry out subsequent passes in or on said layers while guaranteeing processing uniformity between passes and full exploitation of the device capabilities. Indeed, the present application enables the implementation of a device characterized by improved stability and capability of being put into contact with different portions of the layer to be processed located at different heights or levels with respect to a reference height or level.

The present invention is based on the general concept that the disadvantages or drawbacks typical with the solutions known from the prior art (in particular with the devices for demolishing or/or milling surfaces or layers which are known in the prior art) may be overcome or at least minimized by implementing a device for processing horizontal, vertical or inclined solid surfaces or layers in which the position of the supporting elements in contact with the layer to be processed may be individually adjusted for at least one of the supporting elements. In particular, the drawbacks typical with the devices of known type can be overcome or at least minimized by means of a device as claimed, i.e. by means of a device for the demolition and in particular for milling horizontal, vertical and inclined surfaces or layers suitable for pedestrians and/or vehicles such as for instance surfaces or layers made of asphalt or concrete or like solid materials, said device comprising rotatable working means rotatably fixed to a main supporting frame, which comprises a first supporting element and a second supporting element each of which define a contacting portion adapted to be brought into contact with a corresponding portion of said surface or layer. The device further comprises regulating means adapted to regulate and/or select the position of the first supporting element with respect to the main frame independently of the position of the second supporting element, so as to allow the first and second contacting portions, defined respectively by the first and second supporting elements, to be brought into contact with surface portions of said layer which lie at different levels with respect to a reference level. The regulating means of the device comprise an arm or lever fixed to the main frame so as to be free to rotate or translate. The first supporting element is fixed to a portion of the arm so as to be free to rotate with respect to the arm. In this case the working means (drum) can be steadily maintained in the desired working position; furthermore, the working capacity of said means (width) can be fully exploited so that adjacent furrows can be formed without any non-removed or non-processed material lying between them, by means of two subsequent passes. Furthermore, since the first supporting element is free to rotate about the arm, it is allowed to adapt to unevenness and/or irregularities of the surface with which the contacting portion of the first supporting element is in contact during the advancement of the device while processing and/or milling a layer of surface. Therefore, in a case of the device advancing on an uneven or rough surface, this feature prevents the device from leaning forward, backward or sideways, thereby keeping it stable in the operating position. Further advantages can be obtained by means of the embodiment of the present invention claimed, i.e. by means of a device in which said working means comprise a milling drum rotatable about a main axis of rotation, and in which the distance between said contacting portion defined by said first supporting element and said main axis of rotation may be regulated so as to be different from the distance between said contacting portion defined by said second supporting element and said main axis of rotation. Yet further advantages can be obtained by means of a device in another embodiment, i.e. by means of a device in which said working and/or milling means are rotatably fixed to said main supporting frame in a fixed and predetermined position and comprising regulating means adapted to allow the regulation and/or selection of the position of said contacting portion defined by said first supporting element with respect to said main supporting frame independently of the position of said contacting portion defined by said second supporting element with respect to said main supporting frame. Further advantages are guaranteed by the device according to another embodiment in which said regulating means comprise a first class lever rotatably fixed to said main frame, and in which said first supporting element is fixed to a first end portion of said lever which defines the load of said lever. Yet further advantages are guaranteed by a device according to another embodiment in which said first supporting element is rotatably fixed to said first end portion of said lever. Further advantages are guaranteed by a device according to another embodiment, in which said first end portion of said lever comprises a circular or disk-shaped portion and in which said lever is rotatably fixed on a pin or fulcrum of said main frame arranged at a position eccentric with respect to the center of said circular or disk-shaped portion.

Yet further advantages will be guaranteed by the further embodiment of the device according to the present invention defined in the further dependent claims.

BRIEF DESCRIPTION OF THE FIGURES

In the following, the present invention will be clarified by describing some of its embodiments represented in the enclosed figures and drawings. However, it is to be noted that the present invention is not limited to the embodiments represented in the figures; conversely, all represented and described variations or modifications of the embodiments which will be clear obvious, and immediate to the skilled person are a part of the scope and the object of the present invention. In particular, in the enclosed figures.

DETAILED DESCRIPTION OF SOME EMBODIMENTS OF THE PRESENT INVENTION

Figure 1:
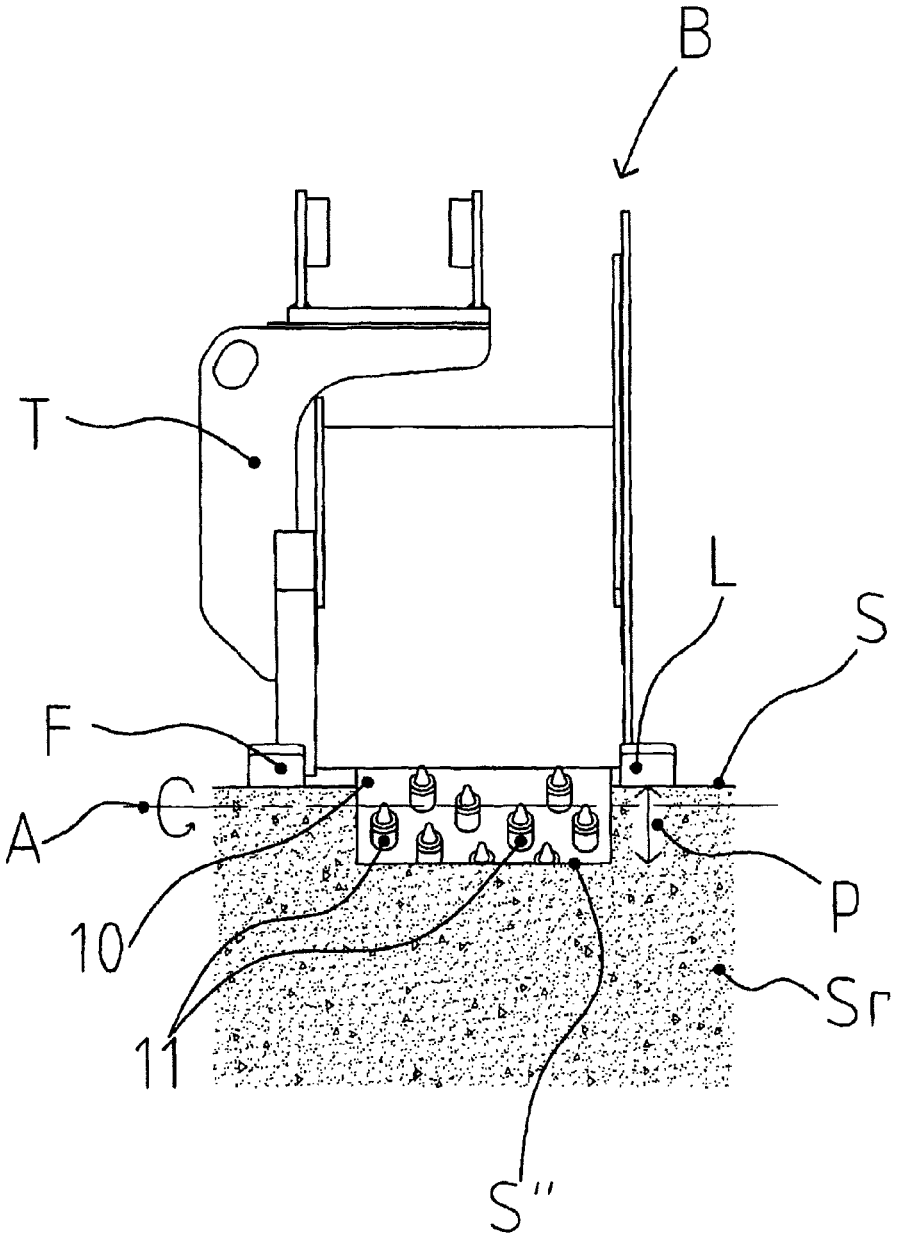
Fig. 1 (Prior Art)
FIG. 1 shows a front view of a device of known type in the state of the art.
Figure 2:
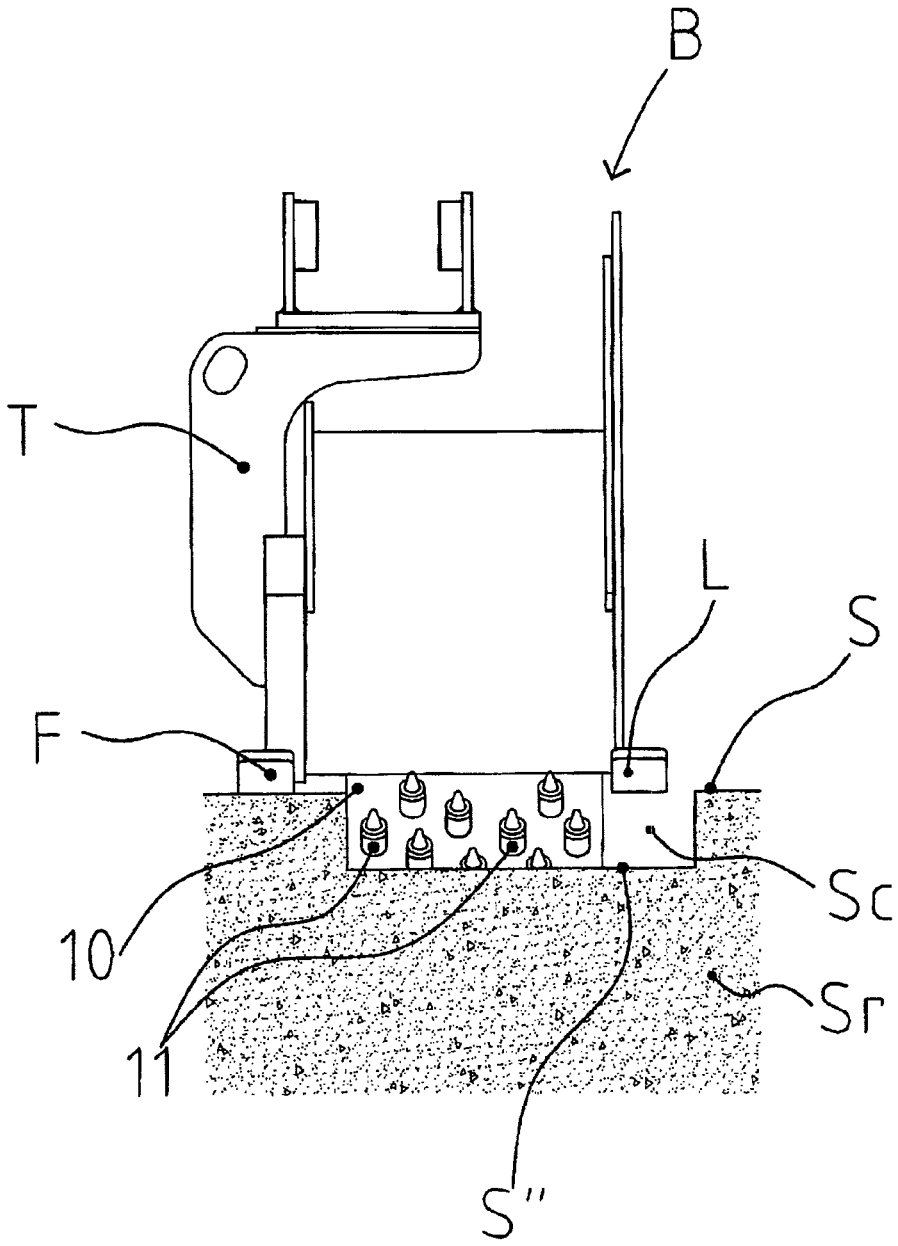
Fig. 2 (Prior Art)
FIG. 2 shows a front view of a device of known type in the state of the art during a particular processing stage.
Figure 3B:
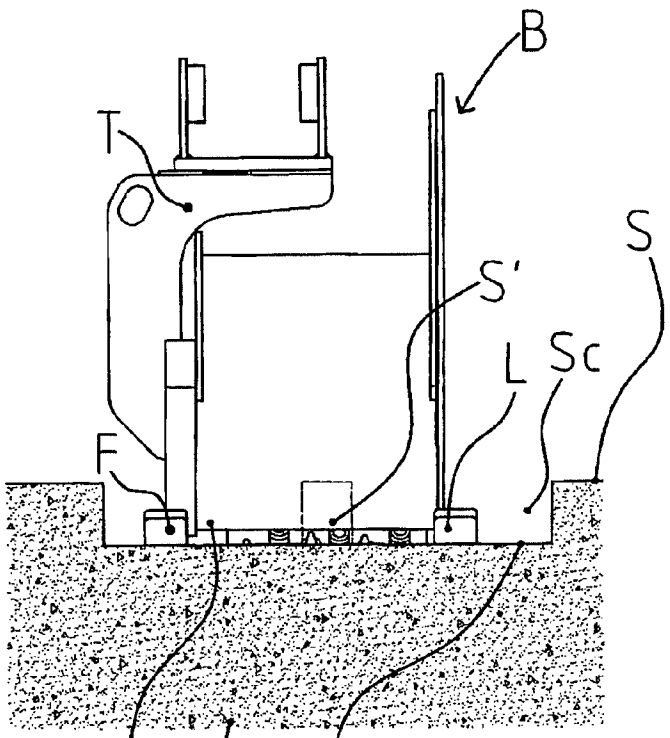
Fig. 3b (Prior Art)
FIG. 3*b* shows a front view of a device of known type in the state of the art during a further processing stage.
Figure 3A:
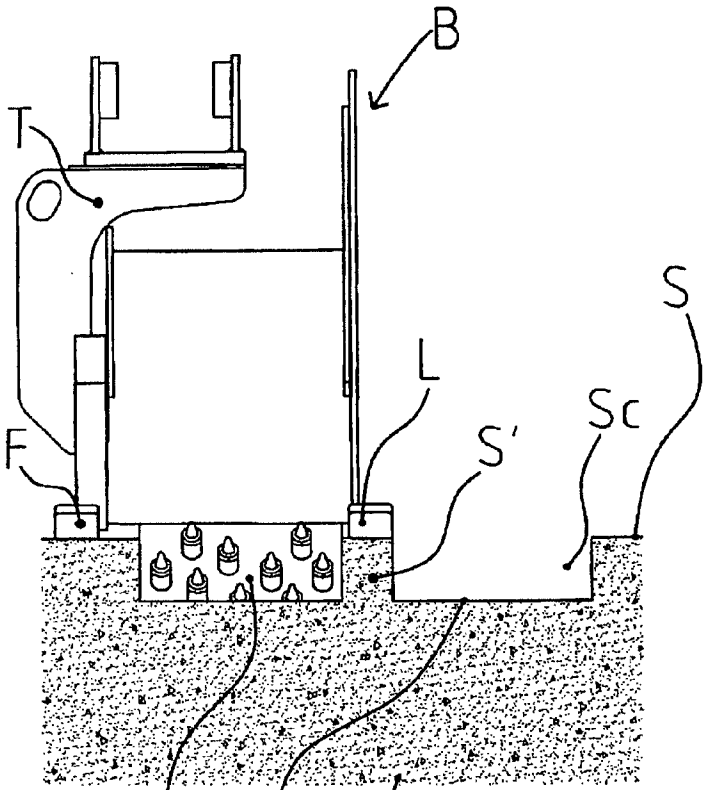
Fig. 3a (Prior Art)
FIG. 3*a* shows a front view of a device of known type in the state of the art during a further processing stage.
Figure 4:
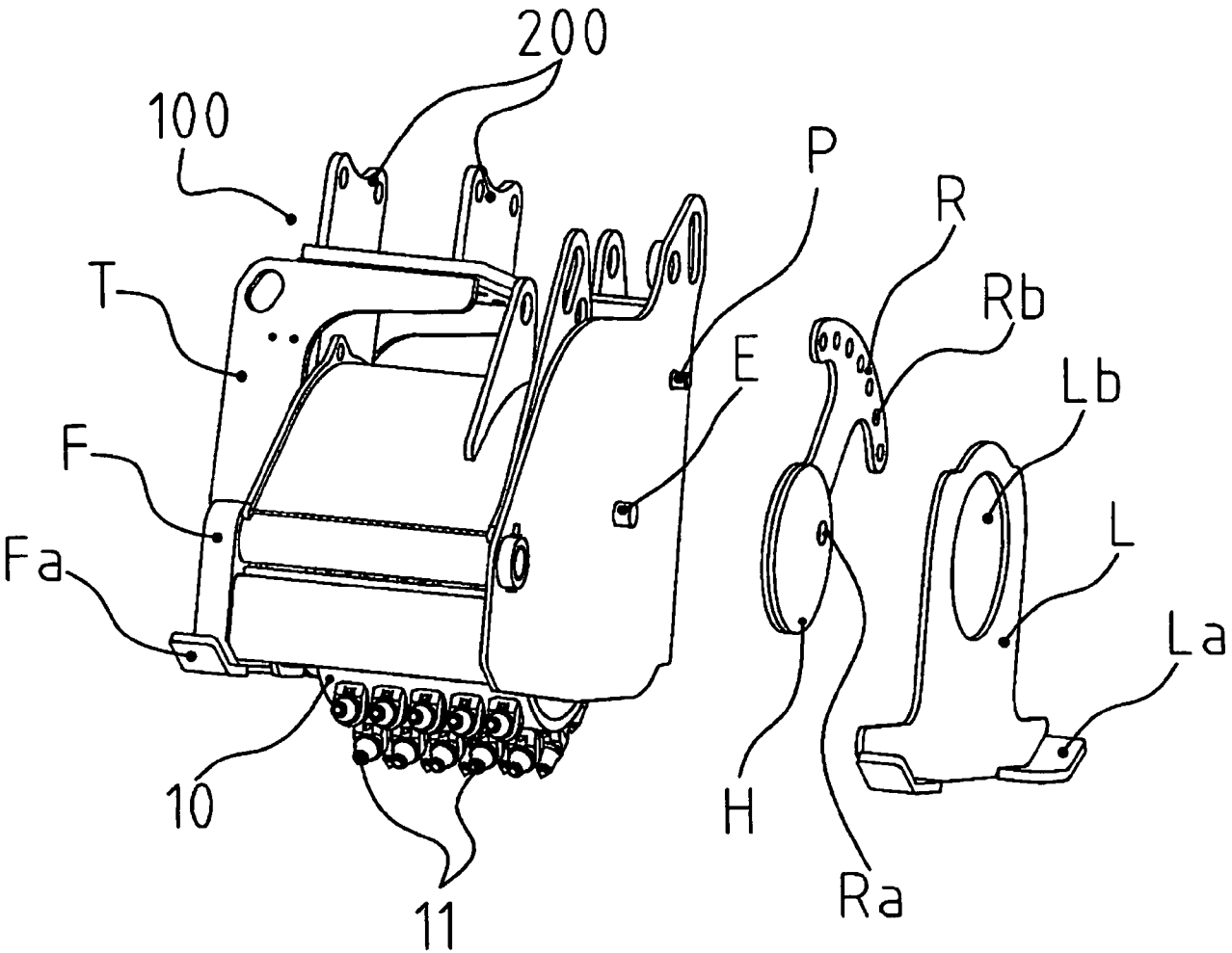
FIG. 4 shows an exploded perspective view of an embodiment of the device according to the present invention.
Figure 5B:
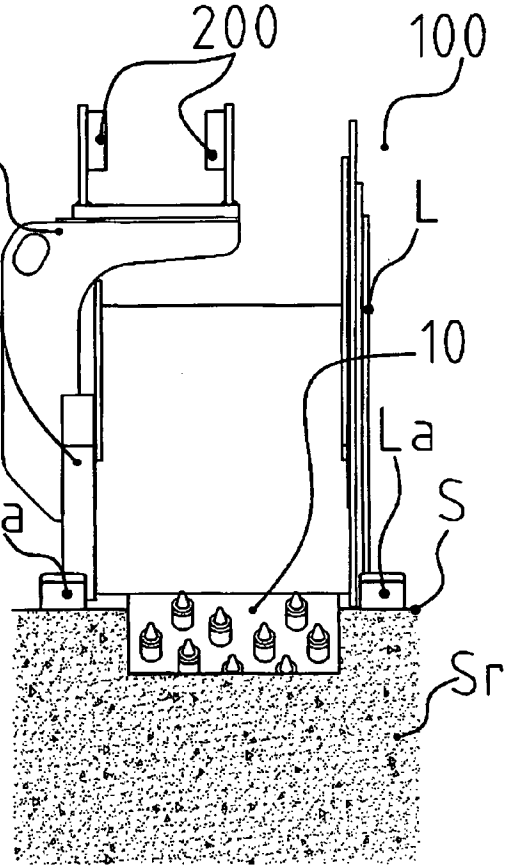
FIGS. 5*a* and 5*b* show a side view and a front view of a device according to an embodiment of the present invention, respectively.
Figure 5A:
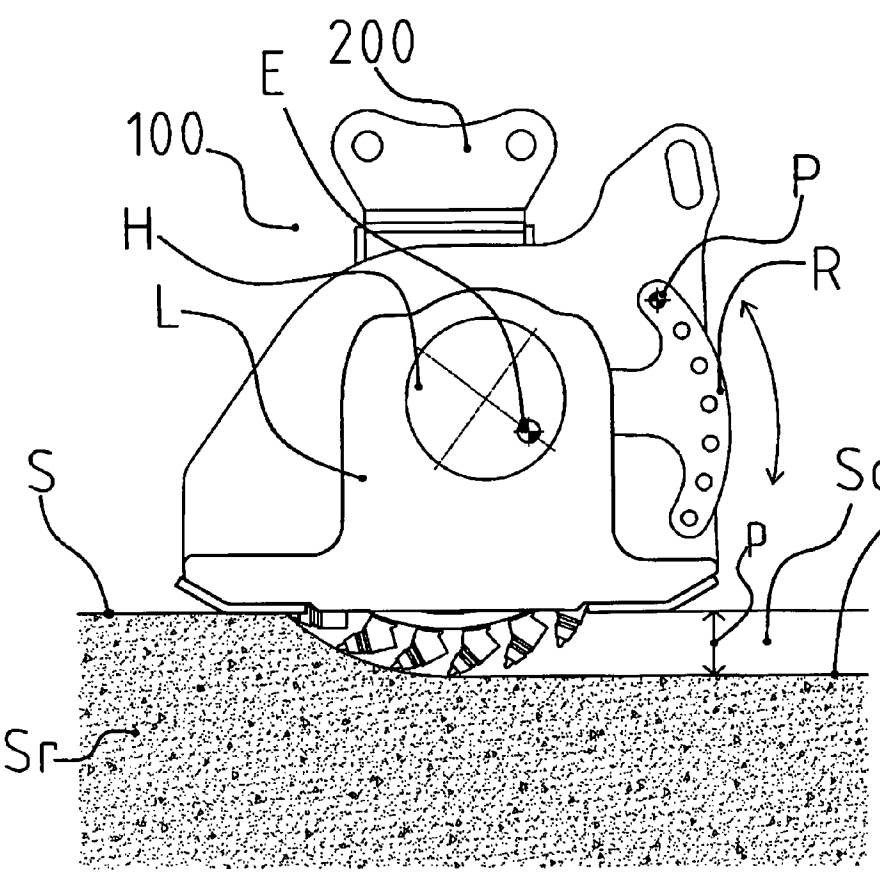

In FIGS. 4, 5*a* and 5*b*, the device according to the embodiment represented therein is identified by reference number 100. As apparent from the Figures, the device 100 comprises a main frame T onto which a processing and/or working and/or milling drum 10 is rotatably fixed. From the outer surface of the drum 10, milling tools 11 extend outwards. The milling drum is, in particular, rotatable about a main axis of rotation substantially coincident with its own axis of symmetry. Furthermore, the milling tools 11 can, depending on the needs and/or circumstances, be fixed or interchangeable. The main frame T also comprises connecting and/or fixing means 200 which allow the device 100 to be fixed to a main operating machine. In particular, the main operating machine can be of the type represented in FIGS. 8 and 9, i.e. a type comprising an articulated connecting main arm which allows the same device to be actuated and moved, in particular, to be positioned in the desired working position. Please refer to the following description for a detailed description of FIGS. 8 and 9. Alternatively, the operating machine can be of the type in which the device is fixed to the front part of the same main operating machine. The main frame T is provided with two supporting slides F and L fixed on opposite sides of the main frame. During use, as shown in FIGS. 5A and 5B, the two opposite slides F and L come into contact with the upper surface S of a layer Sr to be processed and/or milled, for example, a layer made of asphalt, concrete or like materials suitable for pedestrians and/or vehicles. For this purpose, the two supporting slides F and L each define a contacting portion and/or surface Fa and La, respectively, adapted to be brought into contact with corresponding portions of the upper surface S of layer Sr to be processed. From FIGS. 5A and 5B it can thus be seen that with the portions Fa and La in contact with the surface S of the layer Sr, the slides F and L define the position of the drum 10 with respect to the same slides and, consequently, the position of drum 10 with respect to the main frame T, as well as the working depth p of the drum 10. In this respect, it should be noted that the device 10 is provided with means for adjusting or regulating the position of the two slides F and L simultaneously with respect to the main frame T and, thus, with respect to the drum 10. Said means for simultaneously regulating the two slides F and L allow the position of the slides to be adjusted in such a way that the respective contacting portions Fa and La, with the drum 10 (with its main axis of symmetry and/or rotation) in a substantially horizontal position, come into contact with respective portions of the surface S lying at an equal height or level with respect to a reference height or level. Said means for simultaneously regulating the position of the two slides F and L are not included in the scope of the present invention and, therefore, will not be clarified in detail for the sake of conciseness.

The device 100 will, for example, enable the working or processing stage shown in FIGS. 5A and 5B, when the slides F and L are positioned with respect to the main frame T (with respect to the drum 10) in such a way that the respective portions Fa and La of the slides F and L come into contact (with the drum 10 in a substantially horizontal position) with corresponding portions of the surface S lying substantially at the same level with respect to a reference height or level. In particular, during this processing stage, a sub-layer of depth p will be removed or milled away from layer Sr, thereby forming a furrow Sc in the layer Sr.

The device 100 according to the present invention is however also provided with means adapted to enable independent adjustment of the position of the slide L with respect to the main frame T and, thus, with respect to the slide F and to the drum 10. Said further regulating means will thus allow the slide L to be positioned in such a way that, with the drum 10 in a substantially horizontal position, the respective contacting portions Fa and La of the slides F and L may be brought into contact with corresponding portions of the layer Sr (of its upper or exposed surface) lying at different levels with respect to a reference level or height.

For this purpose, as shown particularly in FIG. 4, the device according to the embodiment of the present invention represented therein comprises a lever R pivoted on a main frame T. In detail, the lever R comprises a first end portion H and a second end portion opposite to said first end portion H. Furthermore, the first end portion H comprises an engaging or housing seat adapted to be engaged by (to house) a pin E which protrudes outwards from the frame T and extends along a direction substantially parallel to the rotation and/or symmetry main axis of the drum 10. With particular reference to FIGS. 4, 5*a* and 5B, one can thus see that the load will be applied to the first end portion H of the lever R, and that the effort can be applied to the second end portion of the lever R opposite to the first end portion H, and that the fulcrum constituted by the pin E engaged in the seat Ra will be positioned between the first end portion H and the second end portion of the lever R and, thus, between the effort and the load. In other words, the lever R constitutes a first class lever. Still with reference to FIGS. 4, 5A and 5B, it can also be seen that the first end portion H of the lever R is of a substantially circular or disc-like shape and that the arm of the lever R extends from said substantially circular or disc-shaped portion H. Furthermore, the receiving or engaging seat Ra of the pin or fulcrum E is positioned within the circular or disc-shaped portion H, in a position eccentric with respect to the centre of the circular or disc-shaped portion H (see, in particular, FIG. 5A).

Figure 6B:
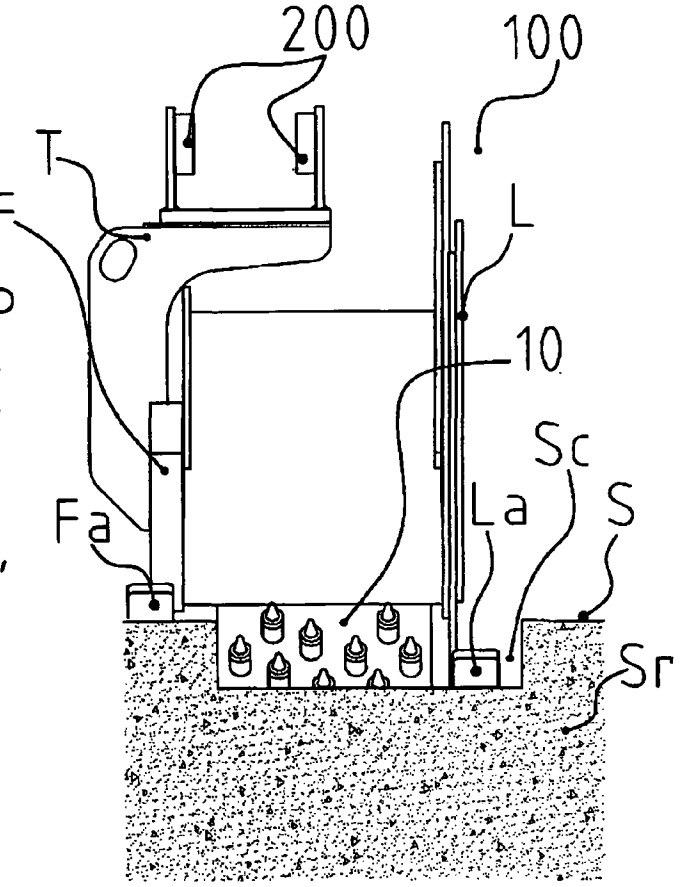
FIGS. 6*a* to 6*b* show a side view and a front view, respectively, of a device according to an embodiment of the present invention during a processing stage subsequent to that represented in FIGS. 5*a* and 5*b;*
Figure 6A:
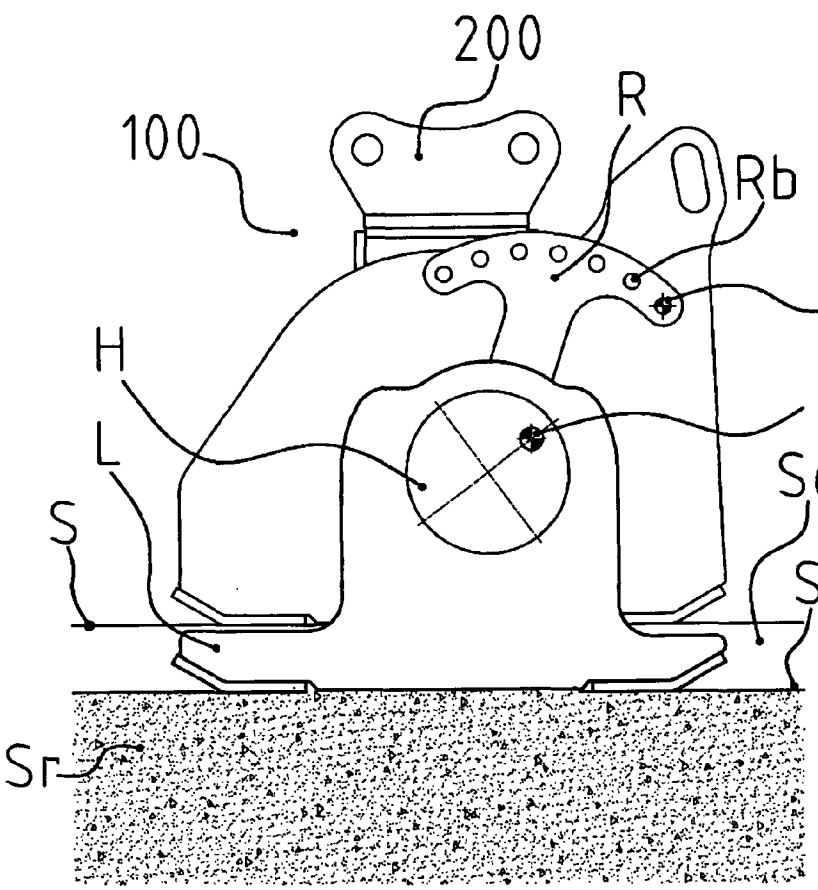

The lever R can thus be activated as schematically shown in FIG. 5A. In particular, the end of the lever R opposite to the circular or disc-shaped end portion H can be rotated as shown by the arrow in FIG. 5A. Since the slide L is provided with its own housing, receiving portion or seat Lb (in particular, a through-hole) in which the circular portion H of lever R is housed, one can understand that a rotation of the lever R as indicated by the arrow in FIG. 5A results in a translation (substantially from bottom to top and vice versa) of the slide L. In particular, by rotating the lever R upwards, the slide L will be translated downwards, whereas by rotating the lever R downwards, the slide F will be translated upwards. Therefore, by operating on the lever R as described above, the slide L can be positioned in such a way that the contacting or supporting portion La is positioned at a different level with respect to that at which the contacting or supporting portion Fa of the slide F is positioned. This feature of the device according to the embodiment of the present invention represented in the Figures allows for carrying out processing stages, for example, as shown in FIGS. 6A and 6B, in which components or features of the device already described with reference to other Figures are identified with the same reference numbers. For example, if one wishes to form in the layer Sr a second furrow immediately adjacent to and, therefore, in contact with a first already-formed furrow Sc (in such a way as not to leave, between said first and second furrows, any portions of the layer Sr which are still to be milled, removed or processed) it will be possible to position the device as shown in FIG. 6*b*. In particular, the device can be positioned with respect to the first furrow Sc in such a way that the contacting portion Fa of the slide F comes into contact with the upper or exposed main surface of the layer Sr, in such a way that the drum 10 is positioned in correspondence to a portion of layer Sr still to be processed and immediately adjacent to the first furrow Sc, as well as in such a way that the slide L is positioned in correspondence to said first furrow Sc, for example, in a position immediately adjacent to the layer Sr still to be removed, and thus, in a position substantially corresponding to the edge of the furrow Sc in contact with the portion of layer Sr still to be processed and/or milled. When the device 100 is positioned as described above, the position of the slide L may be adjusted or regulated by means of the lever R in such a way that its contacting portion La comes into contact with a corresponding portion of the exposed surface S" of the furrow Sc. It will thus be possible to maintain a drum 10 in the desired working position (substantially horizontal in FIG. 6*b*). However, in this case, in contrast to the apparatuses known from the state of the art, the contact or support of the portions Fa and La of the slide F and L with corresponding portions of surface S and surface S", respectively, will guarantee the necessary and required stability without risking that the device is laterally slanted and, thus, that the drum 10 may assume undesired positions. It is also to be noted that, in order to allow the slide L to be positioned at the required level (substantially depending on the level difference between the surfaces S and S" and, thus, on the depth p of the first formed furrow Sc), the lever R is provided with fixing means which allow the lever R to be fixed to the main frame T at predefined positions. In particular, the lever R comprises a series of through-holes or housing or receiving seats Rb, in which a pin P is engaged or is received. The pin P protrudes from the main frame T and extends outwards along a direction substantially parallel to the symmetry and/or rotation main axis of the drum 10 and to the direction along which the pin or fulcrum E extends. An operator who wishes to position the slide L in the position required by the working conditions will act upon the lever R (on the end portion opposite to the circular or disc-shaped end portion H with respect to the fulcrum E) by rotating it clockwise or counter-clockwise as shown by the arrow in FIG. 5*a* and, once the desired position for the slide L has been reached, will proceed to engage the pin P in the engaging or receiving seat Rb which will be positioned substantially in correspondence to the pin P. For this purpose, depending on the needs and/or circumstances, the device 10 may be provided with a pin P which can be translated along a direction substantially parallel to its own symmetry axis and, therefore, adapted to be alternatively extracted from and inserted into the frame T. Otherwise, the lever R can be translated or moved so as to alternatively be pulled further away from or closer to the main frame T.

In the following, with reference to FIGS. 7A to 7C, further features of the device 100 according to the present invention will be clarified and described. Also, in the case of FIGS. 7A to 7C, those features and/or components of the device according to the present invention which have already been previously described with reference to other Figures, are identified in FIGS. 7A to 7C by the same reference numbers.

Figures 7A, 7B, 7C:
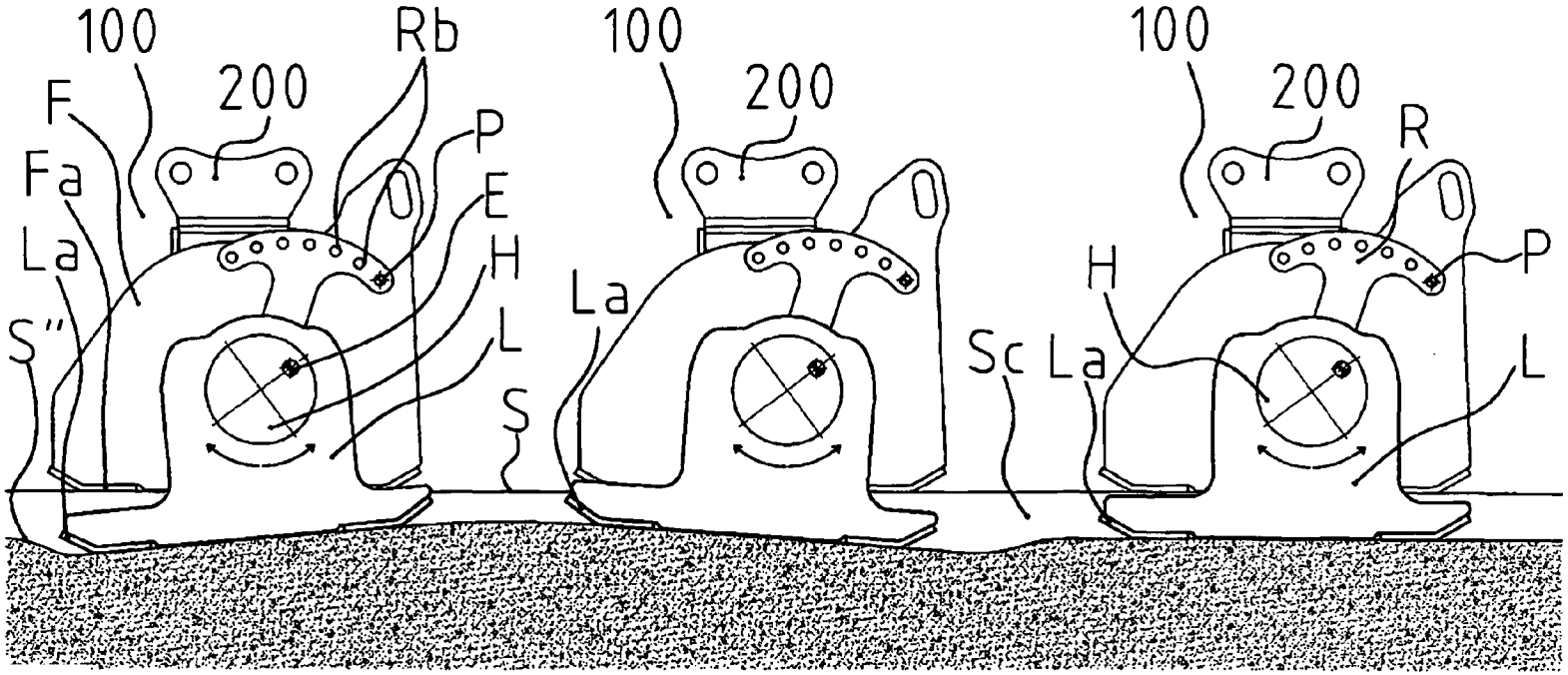
FIGS. 7*a* to 7*c* show respective side views of the device according to an embodiment of the present invention.

An important feature of the device according to the present invention which can be appreciated from FIGS. 7A to 7C, relates to the fact that the slide L is fixed to the lever R so that the slide L is free to rotate with respect to the lever R. This is achieved, in particular, by rotatably engaging the circular portion H of the lever R in the corresponding receiving seat Lb of the slide L. One can thus understand that the internal diameter of the seat Lb substantially corresponds to the external diameter of the portion H of the lever R.

Since the slide L is free to rotate about the portion H of the lever R, it is allowed to adapt to unevenness and/or irregularities of the surface S" with which the contacting portion La of the slide L is in contact during the advancement of the device 100 while processing and/or milling a layer Sr (and thus, substantially from right to left in FIGS. 7*a* to 7*c*). Therefore, in a case of the device 100 advancing too quickly, this feature prevents the device 100 from leaning forward, as well as it keeps the drum 10 in the desired position set by adjusting the position of the slide L. Depending on the needs and/or circumstances, the slide F can also be fixed to the main frame T so as to be rotatable with respect to said main frame T.

According to the embodiment of the present described above, the lever or connecting element R is fixed to the main frame so as to be free to rotate about the pin E fixedly connected to the main frame T. However, it should be noted that other embodiments are possible in which the connecting element R is fixed to the main frame T so as to be free to translate with respect to the main frame T. One of such embodiments will be described in some detail in the following with reference to FIGS. 12, 13A and 13B.

Furthermore, according to the embodiment described above, the supporting slide L is rotatably fixed to a first end portion H of the lever or arm or connecting element R. However, according to further embodiments, the supporting slide L can be fixed to a generic portion of the arm R, not necessarily to one of its end portions. Embodiments in which the supporting slide L is fixed to a portion H of the arm or connecting element R different from an end portion will be described in the following.

In the following, with reference to FIGS. 10, 11A and 11B, a device according to a further embodiment of the present invention will be described and clarified. In this case, in FIGS. 10, 11A and 11B, those features and/or components of the present invention which have been previously described with reference to other Figures, are also identified by the same reference numbers and/or same reference letters.

Figure 10:
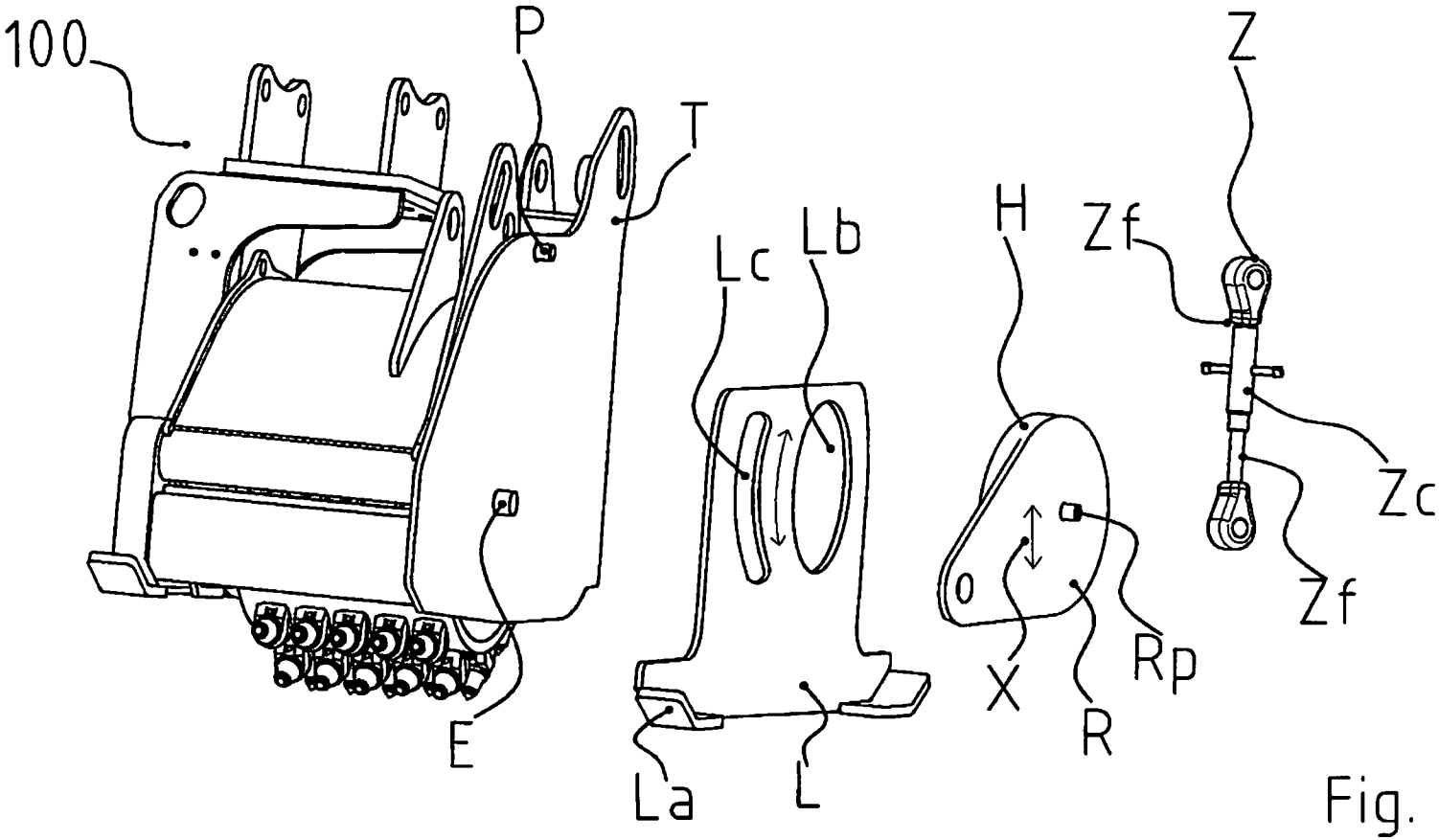
FIGS. 10, 11*a* and 11*b* relate to a perspective view and to two side views, respectively, of a device according to a further embodiment of the present invention.
Figure 11A:
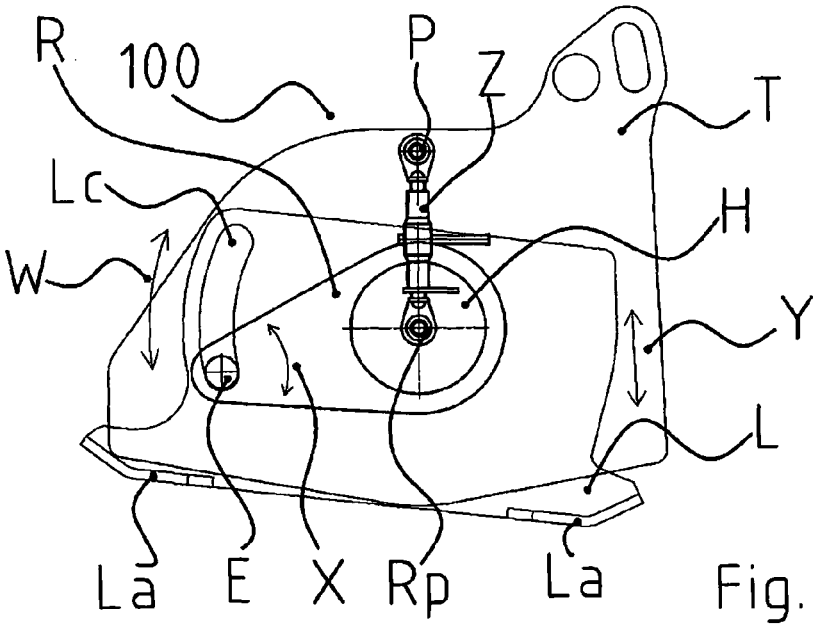
Figure 11B:
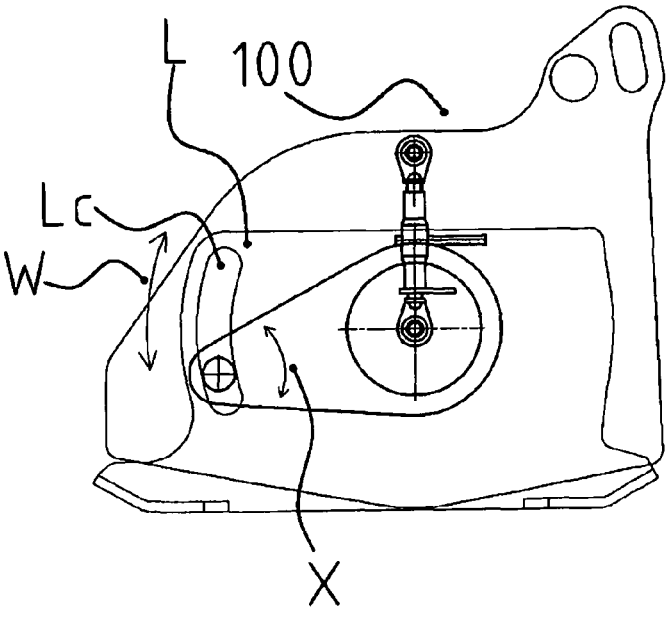

The main frame T of the device 10 shown in FIG. 10 comprises the first pin or fulcrum E which extends outward from the frame T in a direction substantially parallel to the main axis of rotation of the drum 10 (not shown in FIG. 10). A first arm or connecting element R is pivoted on the fulcrum E in such a way that the arm R is rotatable with respect to the fulcrum E in the two clockwise and counter-clockwise directions identified by the double arrow X in FIGS. 10, 11A and 11B. For this purpose, the arm R, in correspondence to a first end portion, comprises a receiving seat Ea adapted to receive and house the pin E (a receiving seat Ea in which the pin E is engaged). Furthermore, the arm R also comprises a connecting pin Rp which extends outwards from the device 100 in a direction substantially parallel to the direction along which the pin or fulcrum E extends. Furthermore, a second arm or connecting element Z is arranged between the pin Rp and a further connecting and/or linking pin which extends from the frame T in a substantially parallel direction to the pins E and Rp. The length or extension of the second arm Z can be adjusted at will and/or depending on the needs and/or circumstances; for this purpose, in the embodiment shown in FIGS. 10, 11A and 11B, the arm Z comprises a hollow central portion Zc and provided with an internal thread. Two threaded end portions Zf (provided with an external thread) are engaged in the two opposite ends of the arm Z, respectively. In other words, a rotation of the central portion Zc of the arm Z about its longitudinal axis of symmetry results in a simultaneous translation of the two threaded end portions Zf. In particular, depending on the direction of rotation of the central part Zc, the two threaded end portions Zf are pushed outwards with respect to the central portion Zc (thereby increasing the length or extension of the arm Z) or inwards with respect to the central portion Zc (and thus, shortening the arm Z). It is evident at this point that, by rotating the central part Zc of the arm Z and, thus, by lengthening or shortening the arm Z, a rotation of the arm R about the fulcrum or pin E (counter-clockwise by shortening the arm Z and clockwise by lengthening the arm Z) is obtained. The arm R further comprises a cylindrical protrusion H which extends from the arm R towards the main frame T and, thus, from the internal surface of the arm R opposite to the external surface of the arm R from which the pin Rp extends. The cylindrical protrusion H of the arm R engages in a receiving seat (a substantially circular through-hole) Lb formed in the slide L. Therefore, the external diameter of the cylindrical protrusion H substantially corresponds to the internal diameter of the engaging and/or receiving seat Lb. Thus, one can understand from the previous description that, by alternatively lengthening and shortening the arm Z, the arm R rotates alternatively clockwise and counter-clockwise, therefore, the slide L is alternatively translated downwards and upwards (see, in this respect, the double arrow Y in FIG. 11A). In other words, the first arm R and the second arm Z, connected to each other (by means of the pin Rp) and to the frame T (by means of the pin E and the pin B, respectively) make up an arrangement which may be identified with a second class lever. Indeed, the effort is applied by means of the arm Z, whereas fulcrum coincides with the pin E. The load, given by the slide L, is applied to the protrusion H of the arm R, and therefore at a position lying between the effort and the fulcrum. By acting upon the arm Z, the position of the slide L with respect to the slide F and to the frame T (as well as with respect to the drum 10) can be adjusted and therefore the contacting portion or surface La of the slide L may come into contact with a corresponding surface portion of the layer Sr to be processed lying at a different level or height from the level or height of the surface portion of the layer Sr which is contacted by the slide F. The embodiment of the device 100 shown in FIGS. 10, 11A and 11B thus offers all advantages offered by the previously described and clarified embodiments of the device according to the present invention.

Furthermore, in the embodiment described above and shown in FIGS. 10, 11A and 11B, the slide L is also free to rotate with respect to the arm R, and therefore with respect to the main frame T. For this purpose, the slide L is provided with a second receiving seat or eyelet Lc adapted to receive the pin or fulcrum E. The semi-circular shape of the eyelet Lc allows, in particular, the slide L to rotate as indicated by the double arrow W in FIGS. 11A and 11B between two opposite end portions defined by the length or extension of the eyelet and in which the fulcrum E comes into contact with the lower and upper end of the eyelet Lc, respectively. Thus, during the operation of the device 100, the slide L can adapt to roughness and/or irregularities of the surface contacted by its contacting portion La.

It is to be noted that, depending on the needs and/or circumstances, the manually actuatable arm Z previously described can be replaced, for example, by a hydraulically and/or mechanically actuatable arm as well as by an arm provided with a spring adapted to automatically define the extension of the arm. In other words, the arm Z can be implemented according to one among the preferred solutions known to the skilled person.

In the following, with reference to FIGS. 12, 13A and 13B, a device according to a further embodiment of the present invention will be described and clarified. In this case as well, in FIGS. 12, 13A and 13B, those features and/or parts of the present invention which have been previously described with reference to other Figures, are identified by the same reference numbers and/or by the same reference letters.

Figure 12:
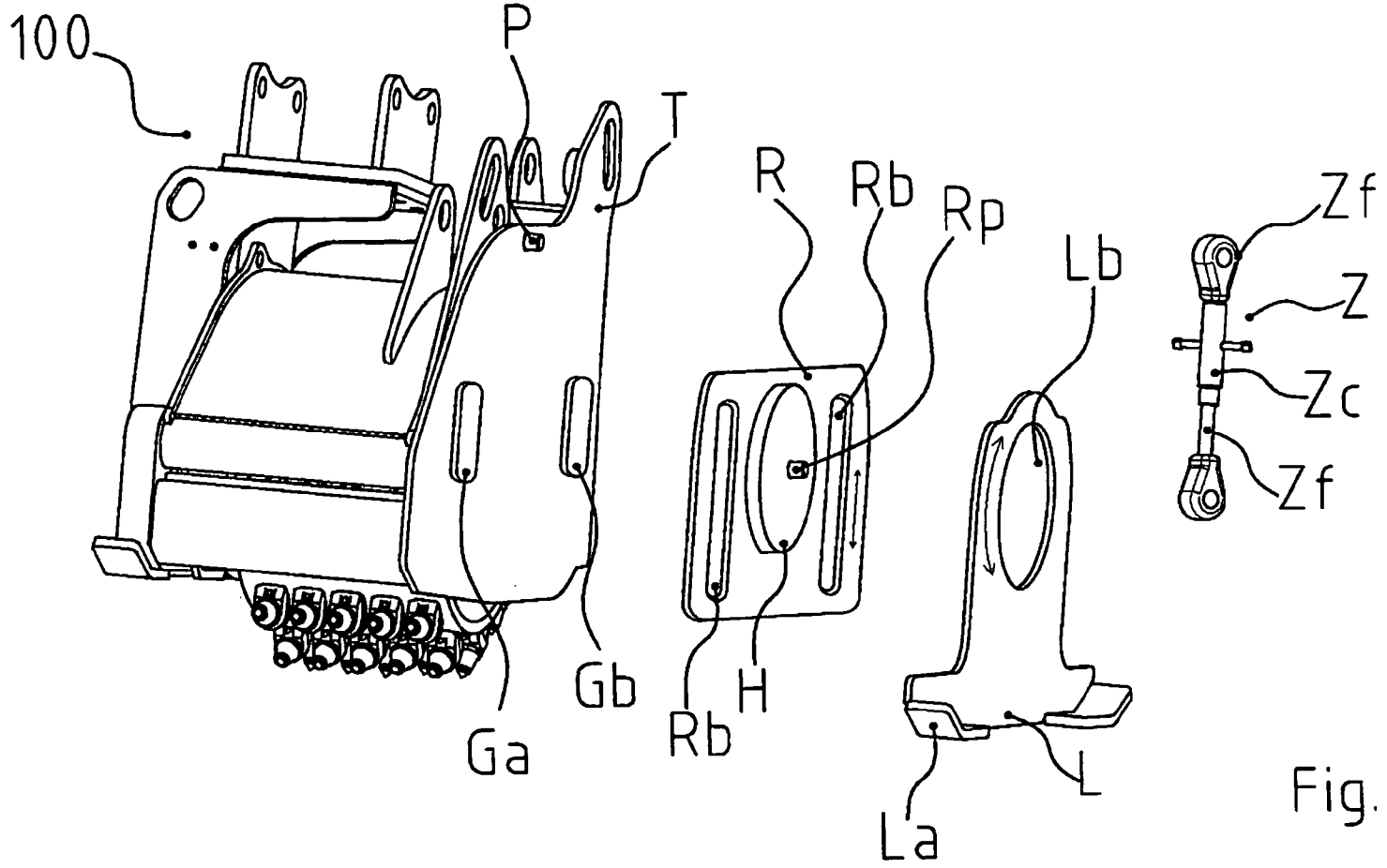
FIGS. 12; 13*a* and 13*b* relate to a perspective view and to two side views of a device according to a further embodiment of the present invention, respectively.
Figure 13A:
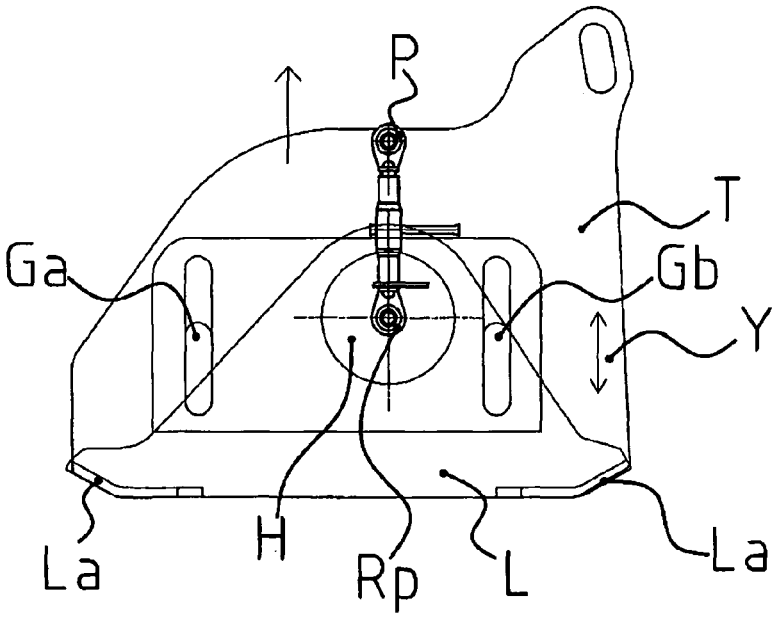
Figure 13B:
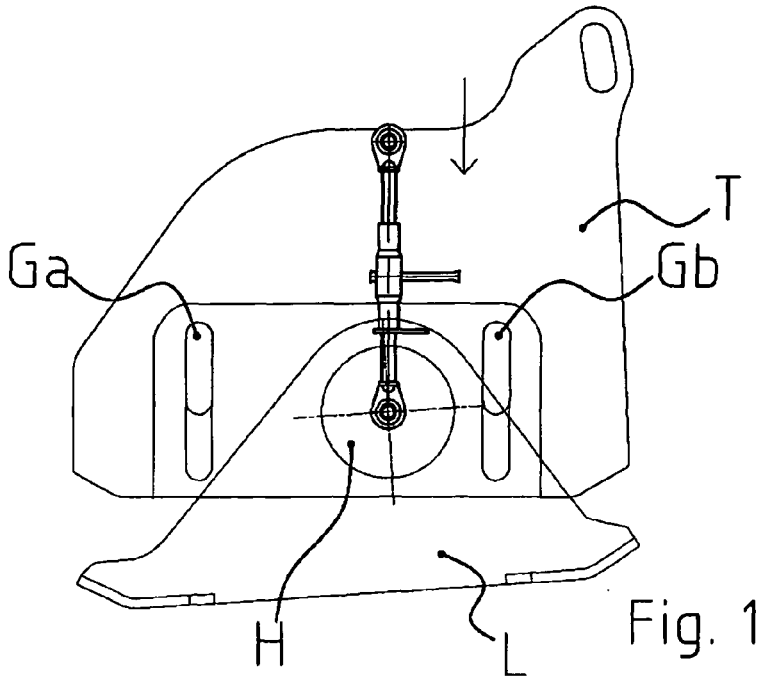

The device 100 according to the embodiment shown in FIGS. 12, 13A and 13B differs from the device according to the embodiment described above and shown in FIGS. 10, 11A and 11B, firstly in that in the embodiment shown in FIGS. 12, 13A and 13B the slide L is positioned at an intermediate position between the arm Z and the connecting or linking element R. In other words, the connecting and/or linking element R is positioned between the main frame T and the slide L.

The frame T of the device 100 shown in FIG. 12 comprises two parallel guides Ga and Gb (with an L- or T-shaped cross-section) which engage in two corresponding receiving seats Rb formed in the connecting element R. Thus, the guides Ga and Gb allow the element R to be translated along a direction substantially parallel to that along which the two guides Ga and Gb extend (from top to bottom and from bottom to top in FIGS. 12, 13A and 13B), as well as to maintain a predefined distance from the frame T. Furthermore, in this case, the arm or element R also comprises a connecting pin Rp which extends outwards from the device 100 in a direction substantially parallel to the longitudinal axis of symmetry and/or of rotation of the drum 10 (not shown in FIGS. 12, 13A and 13B); in particular, the pin Rp extends from a cylindrical portion H which, in turn, extends from the element R outwards with respect to the device 100. Furthermore, in the case of this embodiment a second arm or connecting element Z is also arranged between the pin Rp and a further connecting and/or linking pin which extends from the frame T in a direction substantially parallel to the pin Rp. The length or extension of the second arm Z can be adjusted at will and/or depending on the needs and/or circumstances, as in the case of the embodiment previously described; for this purpose, the arm Z still comprises a central hollow portion Ec provided with an internal thread, in the opposite ends of which, two threaded end portions Zf (provided with an external thread) are engaged. In other words, a rotation of the central portion Zc of the arm Z about its longitudinal axis of symmetry results in a simultaneous translation of the two threaded end portions Zf. In particular, depending on the direction of rotation of the central part Zc, the two threaded end portions Zf are pushed outwards with respect to the central portion Zc (thus increasing the length or extension of the arm Z) or inwards with respect to the central portion Zc (and, thus, shortening the arm Z). At this point, it is evident that by rotating the central part Zc of the arm Z and, thus, by lengthening or shortening the arm Z, a downwards and upwards translation of the element R is obtained, respectively. Furthermore, also in this case, the cylindrical protrusion H of the arm R is engaged in a receiving seat Lb (a substantially circular through-hole) formed in the slide L. Thus, the external diameter of the cylindrical protrusion H substantially corresponds to the internal diameter of the engaging and/or receiving seat Lb. Therefore, from the previous description, one can understand that, by alternatively lengthening and shortening the arm Z, the arm R is respectively translated downwards and upwards, so that the slide L also follows the translation of the element or arm R and is therefore translated respectively and alternatively downwards and upwards (see in this respect, the double arrow Y in FIG. 13A). By acting upon the arm Z, the position of the slide L with respect to the slide F and to the frame T (as well as with respect to the drum 10) can thus be adjusted, so that the contacting portion or surface La of the slide L can come into contact with a corresponding surface portion of the layer Sr to be processed lying at a different level or height from the level or height of the surface portion of the layer Sr which is contacted by the slide F.

Furthermore, in the embodiment described above and shown in FIGS. 12, 13A and 13B, the slide L is also free to rotate with respect to the connecting and/or linking element R, and therefore with respect to the main frame T. In particular, the slide L is fixed to the protrusion H of the connecting element R so as to be free to rotate in the directions indicated by the double arrow drawn on the supporting element L in FIG. 12. Thus, during the operation of the device 100, the slide L can adapt to roughness, unevenness and/or irregularities of the surface contacted by its contacting portion La.

The embodiment of the device 100 shown in FIGS. 12, 13A and 13B thus offers all advantages offered by the previously described and clarified embodiments of the device according to the present invention.

It should be noted that also in this case, and depending on the needs and/or circumstances, the manually actuatable arm Z previously described can be replaced, for example, by a hydraulically and/or mechanically actuatable arm, as well as by an arm provided with a spring adapted to automatically define the extension of the arm. In other words, the arm Z can be implemented according to one of the preferred embodiments known to the skilled person.

Figure 8:
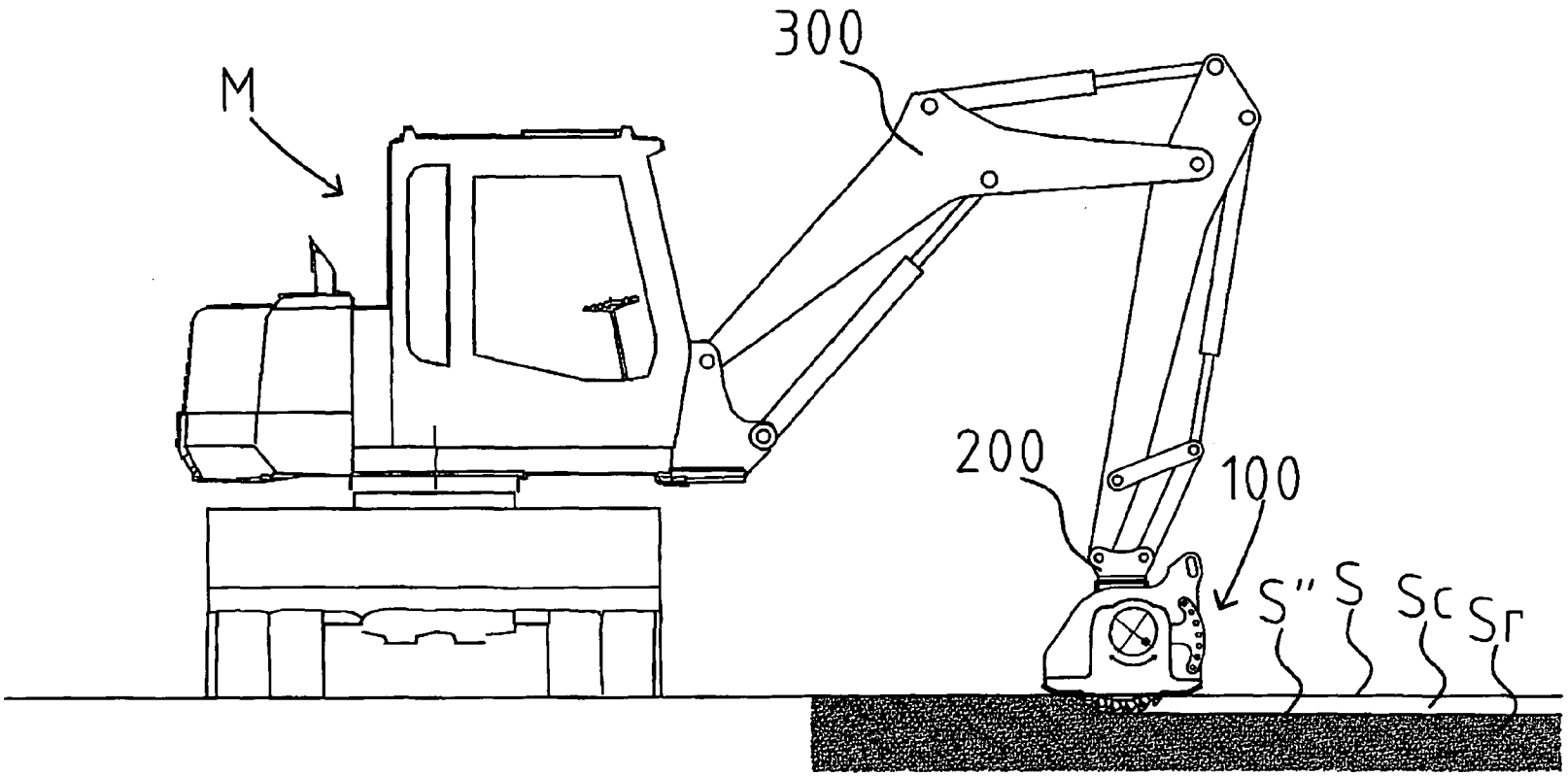
FIGS. 8 and 9 show examples of respective applications and/or uses of the device according to the present invention.
Figure 9:
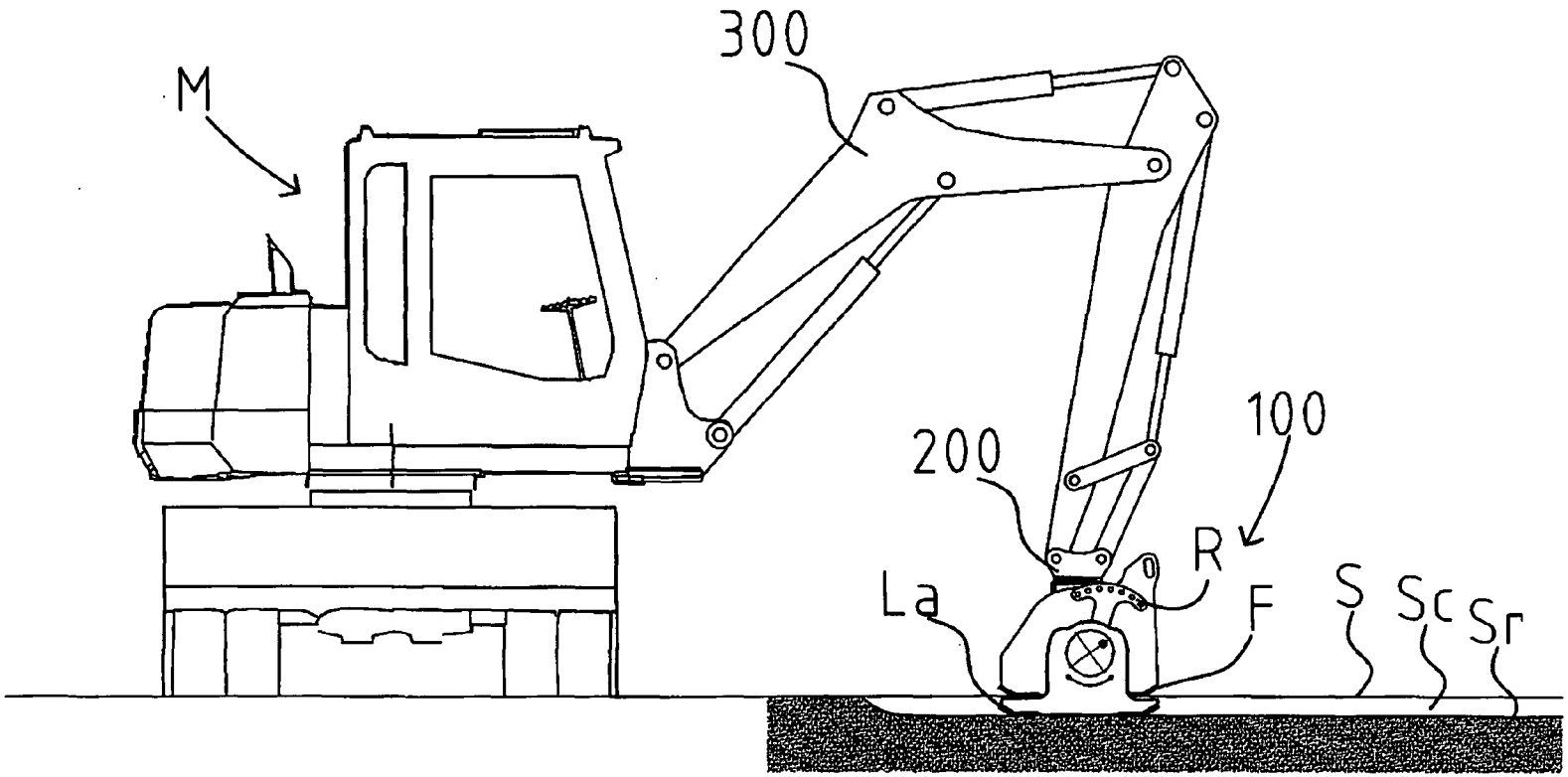

In FIGS. 8 and 9, an example of an application of the device 100 according to the present invention is represented. In particular, in the example of FIGS. 8 and 9, the device 100 is applied to the end of an articulated main arm 300 of a main operating machine M. The device 100 can be mounted to the arm 300 by means of fixing means 200 previously described and with which the device 100 is provided. Moving the device 100 is thus substantially achieved by means of the arm 300, which can, for example, be hydraulically actuatable. The rotation of the working drum 10 of the device 100 can also be induced by a mechanism of a hydraulic type, in particular by means of a hydraulic power source actuated by the operating machine M, the hydraulic power being thus transmitted to the device 100 by means of hydraulic conduits which extend along the arm 300. Advancement of the device 100 is obtained by actuating the arm 300 so as to reduce or increase the distance between the device 100 and the operating machine M depending on the orientation chosen for the device (depending on whether the device is oriented with the drum facing the machine M or vice versa). Alternatively, advancement of the device 100 can be obtained by keeping the arm 100 fixed and moving the operating machine M.

It has thus been proven by means of the detailed description of the embodiments shown in the Figures that the present invention enables achieving the given goals and overcomes, or at least, minimizes the drawbacks typical with systems or devices known from the state of the art. In particular, it has been proven that the device according to the present invention enables an independent regulation of the position of the two supporting slides F and L with respect to the main frame T and/or to the working drum 10. Thus, the solution according to the present invention allows a device for processing, in particular, for milling solid layers, such as for example, surfaces made of asphalt and/or concrete to be steadily positioned in any conditions as well as to form in said layers adjacent and contiguous furrows without leaving any layer portions still to be removed and/or processed between two adjacent and/or subsequent furrows. By means of the present invention, all working capabilities of the device are thus exploited and processing stages, which in the case of a device of known type are necessary for milling and/or processing layer portions between two adjacent furrows, can be avoided. Finally, since at least one of the slides of the device according to the present invention is rotatable about a rotation axis substantially parallel to the rotation axis of the milling drum, the device according to the present invention can adapt to roughness and/or unevenness of the layer to be processed, thereby maintaining the milling drum in the desired working position.

It is important to note that the present invention is not limited to the embodiments previously described and shown in the Figures. Conversely, all those modifications and variations of the embodiments described and shown which are clear to an expert in the field, are a part of the scope of the present invention. For example, the present invention is not limited to manual means for regulating the position of at least one supporting slide but also comprises mechanical and/or hydraulic means (by means of which the slide is hydraulically moved). The scope and the range of the present invention are thus defined by the claims.

What is claimed is:

1. Device for the demolition and in particular for milling horizontal, vertical and inclined surfaces or layers suitable for pedestrians and/or vehicles such as for instance asphalt and/or concrete roads, said device comprising:

rotatable working means rotatably fixed to a main supporting frame which comprises a first supporting element and a second supporting element, each of said first and second supporting elements defining a contacting portion adapted to be brought into contact with a corresponding portion of said surface or layer;

wherein:

said device further comprises regulating means comprising an arm fixed to said main frame so as to be free to rotate or translate, and adapted to regulate and/or select the position of said first supporting element with respect to said main frame independently of that of said second supporting element, so as to allow said first and second contacting portions defined respectively by said first and second supporting elements to be brought into contact with portions of said surface which lie at different levels with respect to a reference level;

and wherein:

said first supporting element is rotatably fixed to a portion of said arm so as to be free to rotate about said arm.

2. Device as claimed in claim 1, wherein:

said working means comprise a milling drum rotatable on a main axis of rotation and in that the distance between said contacting portion defined by said first supporting element and said main axis of rotation may be regulated so as to be different from the distance between said contacting portion defined by said second supporting element and said main axis of rotation.

3. Device as claimed in claim 2, wherein:

said working means are rotatably fixed to said main supporting frame in a fixed and predetermined position.

4. Device as claimed in claim 3, wherein:

said regulating means comprise an arm rotatably fixed to said main frame, and in that said first supporting element is fixed to an end portion of said arm.

5. Device as claimed in claim 4, wherein:

said first supporting element is rotatably fixed to said first end portion of said arm.

6. Device for the demolition and in particular for milling horizontal, vertical and inclined surfaces or layers suitable for pedestrians and/or vehicles such as for instance asphalt and/or concrete roads, said device comprising:

rotatable working means rotatably fixed to a main supporting frame which comprises a first supporting element and a second supporting element, each of said first and second supporting elements defining a contacting portion adapted to be brought into contact with a corresponding portion of said surface or layer;

said device further comprising regulating means adapted to regulate and/or select the position of said first supporting element with respect to said main frame independently of that of said second supporting element, so as to allow said first and second contacting portions defined respectively by said first and second supporting elements to be brought into contact with portions of said surface which lie at different levels with respect to a reference level;

wherein:

said regulating means comprise an arm fixed to said main frame so as to be free to rotate or translate, and said first supporting element is rotatably fixed to a first end portion of said arm;

wherein:

said working means comprise a milling drum rotatable on a main axis of rotation and in that the distance between said contacting portion defined by said first supporting element and said main axis of rotation may be regulated so as to be different from the distance between said contacting portion defined by said second supporting element and said main axis of rotation;

wherein:

said working means are rotatably fixed to said main supporting frame in a fixed and predetermined position; and wherein:

said first end portion of said arm comprises a circular or disk-shaped portion, and in that said arm is rotatably fixed on a pin or fulcrum protruding from said main frame and which is received inside a receiving seat formed in said circular or disk-shaped portion in a position eccentric with respect to the center of said circular or disk-shaped portion.

7. Device as claimed in claim 6 wherein:

said first supporting element comprises a receiving seat circular shaped and therefore adapted to receive said circular or disk-shaped portion of said lever in such a way that a rotation of said arm on its own fulcrum results in a translation of said first supporting element.

8. Device as claimed in claim 7, wherein:

said first supporting element is freely rotatable with respect to said circular or disk-shaped portion of said arm.

9. Device as claimed in claim 6, wherein:

said arm defines a first class lever and in that said first supporting element is fixed to said first end portion of said arm which defines the application point of the resistance of said lever.

10. Device as claimed in claim 9, wherein:

the second end portion of said lever opposite to said first end portion is adapted to be fixed to said main supporting frame so as to define the position of said first supporting element with respect to said main supporting frame and thus with respect to said drum and said second supporting element.

11. Device as claimed in claim 10, further comprising:

a fixing pin which protrudes from said main supporting frame and in that said second end portion of said lever comprises a plurality of receiving seats adapted to receive said fixing pin.

12. Device as claimed in claim 10, wherein:

said receiving seats are disposed along an arc-shaped track.

13. Device as claimed in claim 6, wherein:

said regulating means further comprises a second arm located between said arm and said main frame, in that said arm and said second arm define, in combination, a second class lever and in that said first supporting element is fixed to said end portion of said arm which defines the point of application of the resistance of said lever.

14. Device as claimed in claim 13, wherein:

said second arm is located between said first end portion of said arm and a fixing pin which protrudes from said main frame, and in that the length of said second arm may be regulated depending on the exigencies and/or circumstances, so that increasing the length and decreasing the length of said arm results respectively in a clockwise and a counterclockwise rotation of said arm, and therefore in a translation of said first supporting element fixed to said first end portion of said arm.

15. Device according to claim 1, wherein:

said regulating means comprise a first element or arm adapted to be translated and connected to said main frame by means of an arm the length of which may be regulated, and in that said first supporting element is fixed to said element or arm, so that by regulating the length of said arm said element or arm will be translated along and simultaneously with said first supporting element with respect to said main frame, thus regulating the position of said first supporting element.

16. Device, for the demolition and in particular for milling horizontal, vertical and inclined surfaces or layers suitable for pedestrians and/or vehicles such as for instance asphalt and/or concrete roads, said device comprising:

rotatable working means rotatably fixed to a main supporting frame which comprises a first supporting element and a second supporting element, each of said first and second supporting elements defining a contacting portion adapted to be brought into contact with a corresponding portion of said surface or layer;

said device further comprising regulating means adapted to regulate and/or select the position of said first supporting element with respect to said main frame independently of that of said second supporting element, so as to allow said first and second contacting portions defined respectively by said first and second supporting elements to be brought into contact with portions of said surface which lie at different levels with respect to a reference level;

wherein:

said regulating means comprise a first element or arm adapted to be translated and connected to said main frame by means of an arm the length of which may be regulated, and in that said first supporting element is fixed to said element or arm, so that by regulating the length of said arm said element or arm will be translated along and simultaneously with said first supporting element with respect to said main frame, thus regulating the position of said first supporting element; and wherein:

said main frame comprises two protruding guides which are received in corresponding receiving seats of said element or arm, thus defining the translating direction of said element or arm and therefore the translating direction of said first supporting element.

17. Operating machine equipped with a device for the demolition and in particular for milling surfaces or layers suitable for pedestrians and/or vehicles, wherein said operating machine is equipped with a device as claimed in claim 1.

18. Operating machine as claimed in claim 17, wherein:

said device is fixed and/or connected to said operating machine by means of an articulated working arm adapted to position said device in its working position.

19. Operating machine as claimed in claim 18, wherein:

said working arm is hydraulically activated.

20. A device for milling a road surface comprising:

a main frame;

a milling drum having opposing ends rotatably held within said main frame;

a first slide attached to said main frame adjacent one of the opposing ends of said milling drum and positionable to contact a road surface;

a second slide attached to said main frame adjacent another one of the opposing ends of said milling drum and selectively positionable to contact a road surface independently of said first slide, said second slide having a circular seat opening; and an arm having a circular end portion fitted within the circular seat opening in said second slide, said arm rotatably fixed relative to said main frame in a position eccentric with respect to a center of the circular end portion of said arm, whereby upon rotation of said arm, said second slide moves independently of said first slide permitting said second slide to contact a road surface at a depth different than said first slide.

* * * * *